US005893810A

United States Patent [19]

Umlauft

[11] Patent Number: 5,893,810

[45] Date of Patent: Apr. 13, 1999

[54] TENNIS RACKETS

[75] Inventor: Helmut Umlauft, Hard, Austria

[73] Assignee: Head Sport Aktiengesellschaft, Kennelbach, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 08/695,004

[22] Filed: Aug. 9, 1996

[30] Foreign Application Priority Data

Aug. 22, 1995 [AT] Austria ..... 453/95 U

[51] Int. Cl.[6] ..... A63B 49/00

[52] U.S. Cl. ..... 473/537

[58] Field of Search ..... 273/73 R, 73 C, 273/73 F; 473/537

[56] References Cited

U.S. PATENT DOCUMENTS

| | | | |
|---|---|---|---|
| 31,419 | 2/1861 | Utley . | |
| Re. 31,419 | 10/1983 | Frolow | 273/73 C |
| Re. 33,372 | 10/1990 | Frolow | 273/73 C |
| Re. 34,067 | 9/1992 | Mortvedt et al. | 273/73 C |
| Re. 34,068 | 9/1992 | Mortvedt et al. | 273/73 C |
| 1,539,019 | 5/1925 | Nikonow . | |
| 3,801,099 | 4/1974 | Lair . | |
| 4,291,574 | 9/1981 | Frolow | 73/65 |
| 5,062,634 | 11/1991 | Strauch et al. | 273/67 R |
| 5,368,295 | 11/1994 | Severa et al. | 273/73 |
| 5,507,486 | 4/1996 | Miyamoto | 273/73 F |

FOREIGN PATENT DOCUMENTS

| | | |
|---|---|---|
| 40 21 881 | 1/1991 | Germany . |
| 2203953 | 11/1988 | United Kingdom . |

OTHER PUBLICATIONS

Wilson Sporting Goods Co., 1991 Brochure.

*Primary Examiner*—William E. Stoll

*Attorney, Agent, or Firm*—Flynn, Thiel, Boutell & Tanis, P.C.

[57] ABSTRACT

A tennis racket having a striking surface and a handle in combination has a strung total weight of less than 245 g, an overall length larger than 70 cm, a free-free vibrational frequency in the first mode of more than 210 Hz, a center of gravity of more than 41 cm, and a dynamic center of gravity of more than 50 cm, measured from the handle end.

1 Claim, 1 Drawing Sheet

TENNIS RACKETS

FIELD OF THE INVENTION

The invention relates to tennis rackets, in particular, to tennis rackets that are lighter, stiffer, head heavier and longer than conventional tennis rackets.

BACKGROUND OF THE INVENTION

The high popularity of tennis as a mass sport involves ever increasing demands both on the athletics and technique of a player and on the material. Consequently, in particular the rackets have to be constantly improved in order to increase the playing refinement of both spare-time athletes or amateurs and professional players. The characteristics of a racket that decisively influence the handling of a racket, the precise orientation of the ball, the transfer of the reaction speed of the player onto the ball via the racket, the high acceleration of the ball, and hence an overall pleasant way of playing include the weight of a racket, the center of gravity of a racket and the center of percussion (dynamic center of gravity), measured from the end of the handle, the frequency and the overall length of the racket. The combination of these parameters in connection with the right choice of material directly results in a high stability and precision of striking while simultaneously saving the joints, ligaments and muscles of the player. Conventional known tennis rackets have a weight of about 420 g, a racket length of about 66 cm, a center of gravity of about 33 cm and a dynamic center of gravity of about 42 cm, measured from the end of the racket. The material of the racket was wood with a first mode of vibrational frequency under free-free suspension of the racket of about 90 Hz having been obtainable.

In U.S. Pat. No. 1,539,019 (Nikonow) a tennis racket is proposed, which is lighter, stiffer and head heavier than conventonal rackets. Such a racket weights approximately 340 g, its center of gravity being located about 41 cm, its dynamic center of gravity being located about 50 cm, from the end of the handle. The racket is characterized by a higher stiffness than conventional rackets.

From U.S. Pat. No. 31,419 (Frolow) a tennis racket can be taken, which also is lighter, stiffer and head heavier than conventional tennis rackets. The racket has a weight smaller than 280 g, a distance from the center of gravity to the end of the handle of more than 38 cm, a dynamic center of gravity at a distance of more than 50 cm from the end of the handle and a free-free vibrational frequency in the first mode of more than 155 Hz.

U.S. Pat. No. 5,368,295 (Severa) likewise has a slighter weight, higher stiffness and head heaviness than conventional tennis rackets. Its weight is less than 270 g, the center of gravity is at a distance of more than 39 cm, and the dynamic center of gravity is at a distance of more than 50 cm, from the end of the handle. In the first mode, the racket attains a free-free vibrational frequency of 190 Hz.

DETAILED DESCRIPTION

Figure 1:
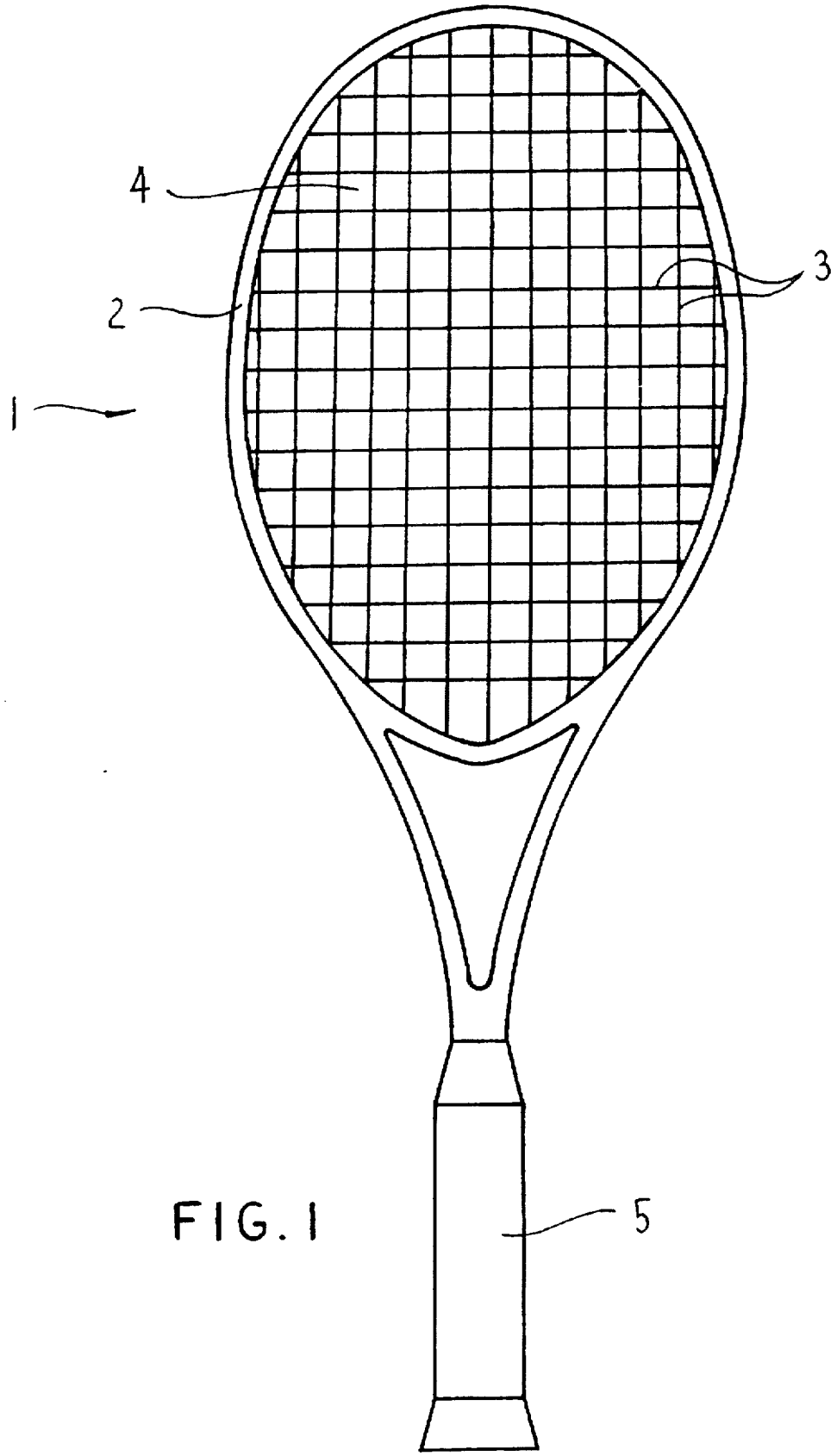
FIG. 1 illustrates a tennis racket constructed according to this invention.

FIG. 1 illustrates a tennis racket 1 according to this invention. Tennis racket 1 includes a head 2 with stringing 3 that forms a striking surface 4. A handle 5 extends downwardly from head 2.

The invention aims at providing a tennis racket 1 of the initially defined kind, with which the striking technique and the striking power are enhanced due to a reduction of weight, an increase in stiffness, head heaviness and overall length, thus improving the quality of playing while offering an elevated comfort. To solve this object, the invention essentially consists in that the tennis racket in combination has a strung overall weight of less than 245 g, an overall length larger than 70 cm, a free-free vibrational frequency in the first mode of more than 210 Hz, a center of gravity of more than 41 cm, and a dynamic center of gravity of more than 50 cm, measured from the end of the handle 5. The lower weight of the racket directly exhibits a protective effect on ligaments, joints and muscles, thus particularly preventing the development of tennis elbows (epicondylitis). Moreover, the reduction of the racket weight will diminish the premature exhaustion of a player. The stiffness of a racket directly influences the dissipation energy lost within the frame and preventing the complete transmission of pulses. Hence, a higher stiffness of the frame results in a better transfer of the impact energy to the tennis ball, reducing to a minimum the energy lost. Both a reduction of the weight and an increase in the stiffness of the racket 1 may be achieved by using lighter and stiffer materials in the manufacture of rackets. The extension of the racket is necessary with a more light-weight construction of the tennis racket in order to reach the moment of inertia of conventional rackets by the parallel displacement of the axis of rotation of the center of gravity. In addition, the active range of a player is increased, thereby enabling balls that have not been reached by conventional rackets to be safely struck. The head heaviness of a racket results from the elevated bearing weight of the head portion relative to the grip portion with the racket being in the horizontal position. By increasing the head heaviness, the striking power transmitted to the ball is strongly increased with the tennis racket 1 according to the invention. Furthermore, this measure helps to prevent the spin-like jerking of the racket at ball contacts beyond the longitudinal axis of the racket and hence harmful repercussions on the wrist, forearm and elbow. In combination with the other parameters implied at the same time, repercussions on the arm and wrists during the impact of a ball on the racket are avoided at an enhanced striking power while keeping the precise ball direction desired. By observing the above-mentioned parameters in configuring a tennis racket of the initially defined kind, marked improvements both in the striking technique and in the quality of playing as well as the playing comfort at the maximum saving of the arm and shoulder zones of the player would, thus, be reached in a surprising manner if the weight of the racket were reduced. The observance of a free-free frequency in the first mode of 210 Hz imparts the racket a high dynamics at a high striking precision, thereby saving the arm even further.

In a particularly advantageous manner, the reduction of weight is brought about by the frame material being a material composed of synthetic fibers and synthetic resin By choosing carbon fiber-reinforced synthetics in connection with a synthetic resin, it has become feasible to attain the above-mentioned parameters and, in addition, to ensure the resistance of the racket to dirt and weather.

What I claim is:

1. A tennis racket including a frame with a head with string forming a striking surface and a handle that extends from the head, the handle having an end, the improvement wherein: the frame is made of a material formed from synthetic fibers and synthetic resin; the tennis racket has an overall length greater than 70 cm; the tennis racket, including the stringing, has an overall weight of less than 245 g; a free-free vibrational frequency in the first mode greater than 210 Hz; a center of gravity located more than 41 cm from the end of the handle; and a dynamic center of gravity located more than 50 cm from the end of the handle.

* * * * *